US007243523B2

(12) United States Patent
Smith

(10) Patent No.: US 7,243,523 B2
(45) Date of Patent: Jul. 17, 2007

(54) METAL UNIT NESTING MACHINE

(76) Inventor: Richard Smith, 1124 W. Thatcher Blvd., Suite 202, Safford, AZ (US) 85546

( * ) Notice: Subject to any disclaimer, the term of this patent is extended or adjusted under 35 U.S.C. 154(b) by 7 days.

(21) Appl. No.: 10/391,665

(22) Filed: Mar. 19, 2003

(65) Prior Publication Data

US 2004/0182126 A1 Sep. 23, 2004

(51) Int. Cl.
*B21D 31/00* (2006.01)

(52) U.S. Cl. ..... 72/379.2; 72/306; 72/363; 72/381; 72/383

(58) Field of Classification Search ..... 72/306, 72/348, 379.2, 379.4, 381, 383, 384, 396, 72/397, 428, 461, 363; 29/505, 401.1
See application file for complete search history.

(56) References Cited

U.S. PATENT DOCUMENTS 2,510,024 A * 5/1950 Mayer ..... 72/397
2,669,914 A * 2/1954 Swaine ..... 493/167
3,440,988 A * 4/1969 Bremer ..... 72/348
4,787,235 A * 11/1988 Van Berkel ..... 72/379.2
5,673,585 A * 10/1997 Bishop ..... 72/447
6,276,044 B1 * 8/2001 Ragland et al. ..... 29/521
6,301,779 B1 * 10/2001 Azar ..... 29/890.03
6,451,447 B1 * 9/2002 Ragland et al. ..... 428/593
2002/0005059 A1 * 1/2002 Smith ..... 72/379.2
2002/0005351 A1 * 1/2002 Smith ..... 204/292

* cited by examiner

*Primary Examiner*—Dmitry Suhol
(74) *Attorney, Agent, or Firm*—Thrasher Associates

(57) ABSTRACT

The invention is a machine, machine system, and method of using a machine that alters metal plates to enable rigid stacking of the metal plates. In a preferred embodiment, the machine system includes a machine cabinet, a first altering system secured in the machine cabinet and configured to enable the machine to produce a divot or other indention in a metal plate, and a second altering system secured in the machine cabinet, the second altering system being configured to interact with the first altering system to change the shape of a metal plate, such as by bending a corner.

10 Claims, 5 Drawing Sheets

METAL UNIT NESTING MACHINE

CROSS REFERENCE TO RELATED APPLICATIONS

The invention is related to and claims priority from U.S. patent application Ser. No. 09/848,189, filed on May 2, 2001, now U.S. Pat. No. 6,675,452 by Richard A. Smith, and entitled Method Of Enabling The Nesting of Metal Units.

TECHNICAL FIELD OF THE INVENTION

The invention relates to preparing metal plates, such as copper cathodes, so that they may be stacked, and then moved or stored, without the use of a securing device, such as a metal band. More particularly, the invention relates to machines that alter metal plates for stacking.

PROBLEM STATEMENT

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Statement of a Problem Addressed by This Invention is to be construed as prior art.

Discussion

Metal plates (also called metal sheets) are often used in industry to facilitate the transportation of metal, and to take advantage of superior melting qualities of plates as opposed to other solid shapes. Common metal plates include copper metal sheets that are used as copper cathodes in mining operations. Similarly, zinc metal sheets are used as anodes in industrial water applications to prevent the "pitting" of metallic containers.

By way of a specific example, in the mining industry, copper cathodes are used in copper bearing solutions of sulfuric acid and water. Accordingly, a process called SXEW (solvent extraction/electrowinning) is used at most copper mines to extract copper from oxide ores by electrowinning copper out of solution. In practice, this process (called leaching) runs copper-containing acid and water through a pile or dump of copper bearing ore, and collects the resulting solution for further processing.

Another method of producing copper cathodes is by electrowinning copper from a smelter produced anode. This method takes copper off of the anode and plates it into a sheet (typically, either stainless steel or a very thin copper starter sheet) to produce a cathode. Accordingly, copper mining, and many other industrial processes, utilize a large number of metal plates.

Sometimes, due to size limitations, space needed in an industrial application, melting qualities, or other factors, a metallic rod is preferable to a metal plate. Accordingly, sometimes the word "metal unit" is used to describe a metal plate/sheet, metal rod, or any other type of stackable metallic processing pieces.

Bundling is the process of gathering and stacking metal units for transport or storage (thus creating a "bundle" of metal units). Although bundling may be interpreted by some to imply the application of a securing device to a bundle, as used herein, bundling means the association of two or more metal units, regardless of geometrical configuration. Typically, although not necessarily, the association is a stacking of the metal units or metal plates.

Unfortunately, many metal units are destroyed or lost in transport between a manufacturing or storing site, and an industrial location that utilizes the metal units. This is because securing devices, such as metal bands, that are used to support metal units in transport are often insufficiently strong to withstand the forces and momentum generated by otherwise apparently static metal units. Accordingly, shearing and other forces often cause metal bands to break, or may cause a stack of metal units to fall over. Accordingly, many metal units fall off trucks, trains, forklifts, conveyor belts, or other transport vehicles. Furthermore, stacks of metal units may fall, or slide in a one-on-top-of-each-other fashion, and damage facilities or equipment. Therefore, it would be advantageous to have devices that alter metal units so that the metal units may be rigidly stacked and the stack may be securely maintained.

SELECTED OVERVIEW OF SELECTED EMBODIMENTS

The invention provides technical advantages as machines, machine systems, and methods of using a machine that alters metal plates to enable rigid stacking of the metal plates. In a preferred embodiment, the machine system includes a machine cabinet, a first altering system secured in the machine cabinet and configured to enable the machine to produce a divot or other indention in a metal plate. The invention also includes a second altering system secured in the machine cabinet, the second altering system being configured to interact with the first altering system to change the shape of a metal plate, such as by bending a corner.

Of course, other features and embodiments of the invention will be apparent to those of ordinary skill in the art. After reading the specification, and the detailed description of the exemplary embodiment, these persons will recognize that similar results can be achieved in not dissimilar ways. Accordingly, the detailed description is provided as an example of the best mode of the invention, and it should be understood that the invention is not limited by the detailed description. Accordingly, the invention should be read as being limited only by the claims.

BRIEF DESCRIPTION OF THE DRAWINGS

Various aspects of the invention, as well as at least one embodiment, are better understood by reference to the following EXEMPLARY EMBODIMENT OF A BEST MODE. To better understand the invention, the EXEMPLARY EMBODIMENT OF A BEST MODE should be read in conjunction with the drawings in which.

AN EXEMPLARY EMBODIMENT OF A BEST MODE

Figure 1:
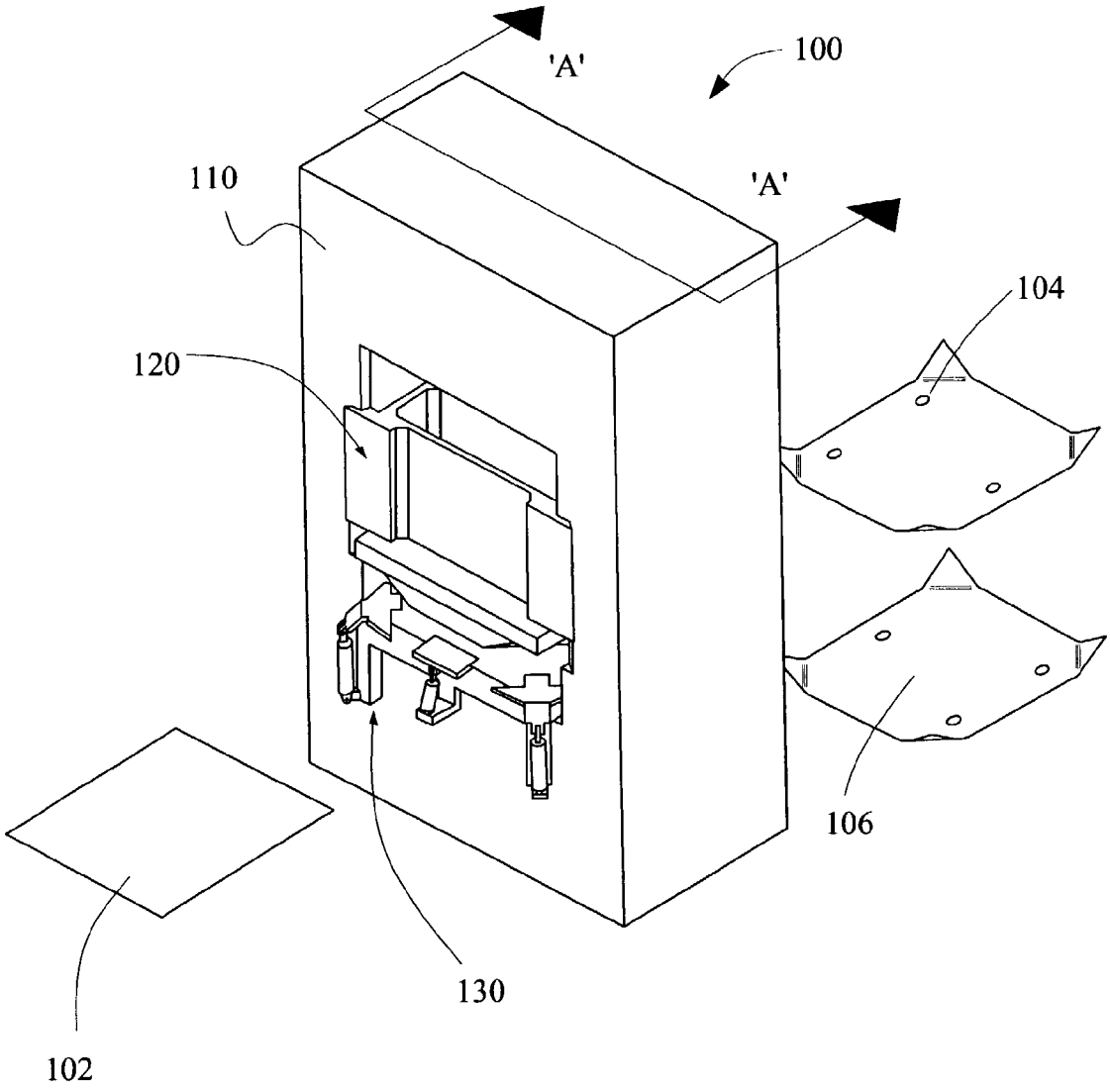
FIG. 1 shows a corner-view of a metal unit nesting machine according to the invention.

The invention defines machines that alter metal plates to enable rigid stacking of the metal plates. In a preferred embodiment, a machine system includes a machine cabinet, a top plate assembly configured to enable the machine to produce a divot or other indention in a metal plate, and a bottom plate assembly configured to interact with the top plate assembly to change the shape of a metal plate, such as by bending a corner.

Interpretation Considerations

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching"). Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for-functioning-"or "step for-functioning-" in the Claims section.

Discussion of the Figures

The invention is better appreciated by examining figures. Accordingly, FIG. 1 shows a corner-view of a metal unit nesting machine system 100 according to the invention. The metal unit nesting machine system 100 generally comprises a cabinet 110, which may be any structure or frame configured to support a first altering system 120 and a second altering system 130 that are discussed in greater detail below. Although not comprising a portion of the invention, a metal unit 102 may be processed by the invention to produce altered metal units 104, 106. Accordingly, it is appreciated that the first altering system 120 and the second altering system 130 are configured to interact with each other to change the shape of a metal unit, to enable rigid stacking of metal units.

The cabinet 110 is preferably adapted to secure the first altering system 120 above the second altering system 130 such that the metal plate 102 may be located or placed between the first altering system 120 and the second altering system 130. In one embodiment, the second altering system 130 is adapted to alter the metal plate 102 such that a plurality of metal plates may be rigidly stacked one on top of the other. Accordingly, in one embodiment the second altering system 130 is adapted to bend a portion of a metal plate, such as a corner of a metal plate. Accordingly, the second altering system 130 may comprise a corner bending system.

Similarly, the first altering system 120 may be adapted to alter a metal plate such that a plurality of plates may be rigidly stacked. For example, the first altering system 120 may be adapted to create at least one dimple or ridge in a metal plate. Preferably, the first altering system 120 creates at least three dimples in a metal plate. In addition, the dimples are preferably arranged in predetermined pattern such that when plates are stacked, the dimples do not line up with each other. Accordingly, the first altering system 120 may comprise a dimpling system.

Figure 2:
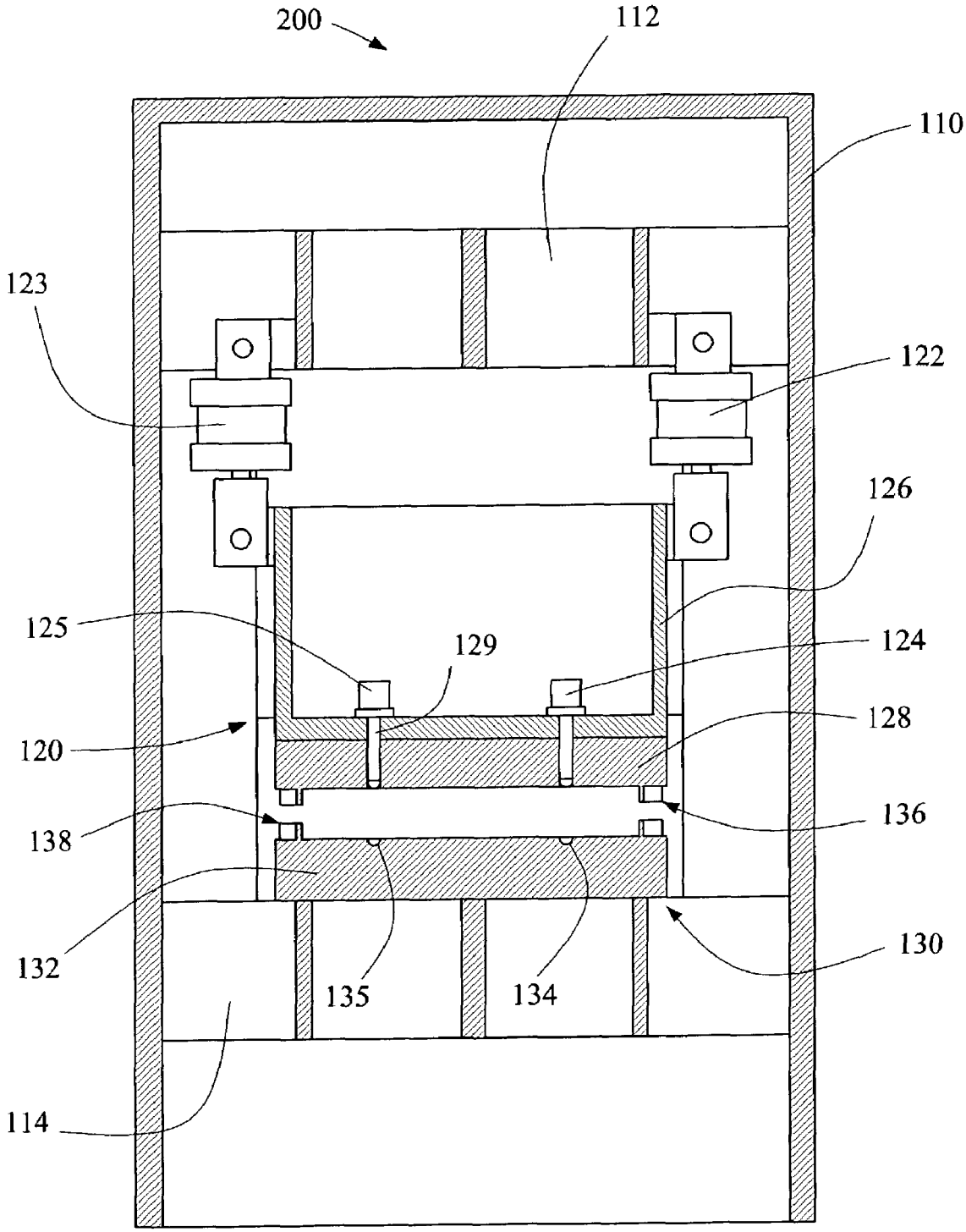
FIG. 2 is a cut-view of FIG. 1 taken along cut-line A—A.

The metal unit nesting machine system 100 may be embodied as a metal unit nesting machine device as illustrated in FIG. 2, which is a cut view of FIG. 1 taken along cut line A—A. Thus, FIG. 2 illustrates a metal unit-nesting machine 200 comprising a cabinet 110 comprising a top portion 112 and a bottom portion 114. A dimpling system 116 is secured to the top portion 112, while a bending system 118 is secured to the bottom portion 114. Generally, the dimpling system 116 includes a removable top plate 128, a dimple tool 124 configured to articulate in and out of dimple guides 129 located within the top plate 128.

In addition, the dimpling system 116 also includes a hydraulic means (not shown) adapted to articulate the dimple tool 124. Preferably, the hydraulic means comprises hoses and hydraulic lines coupled to the dimple tool 124. In addition, the hydraulic means is typically coupled to the plate stacking machine cabinet 110 in a secured manner. Further discussion of the hydraulic means is provided below.

The removable top plate 128 may also have attached thereto a metal plate guide 136 for aligning a metal plate into a desired configuration with the removable top plate 128. Of course, the metal plate guide 136 may be integrally formed with the removable top plate 128, or may be secured or attached to the removable top plate 128. Also shown in FIG. 2 is a top plate support 126 that couples the removable top plate 128 to the cabinet 110 via a first clamp cylinder 122 and a second clamp cylinder 123. The clamp cylinders 122, 123 are in a preferred embodiment hydraulically actuated to pinch a metal plate between the removable top plate and a bottom plate 132. The bottom plate 132 includes a plurality of dimple recesses 134, 135 and a plate guide 138.

Figure 3:
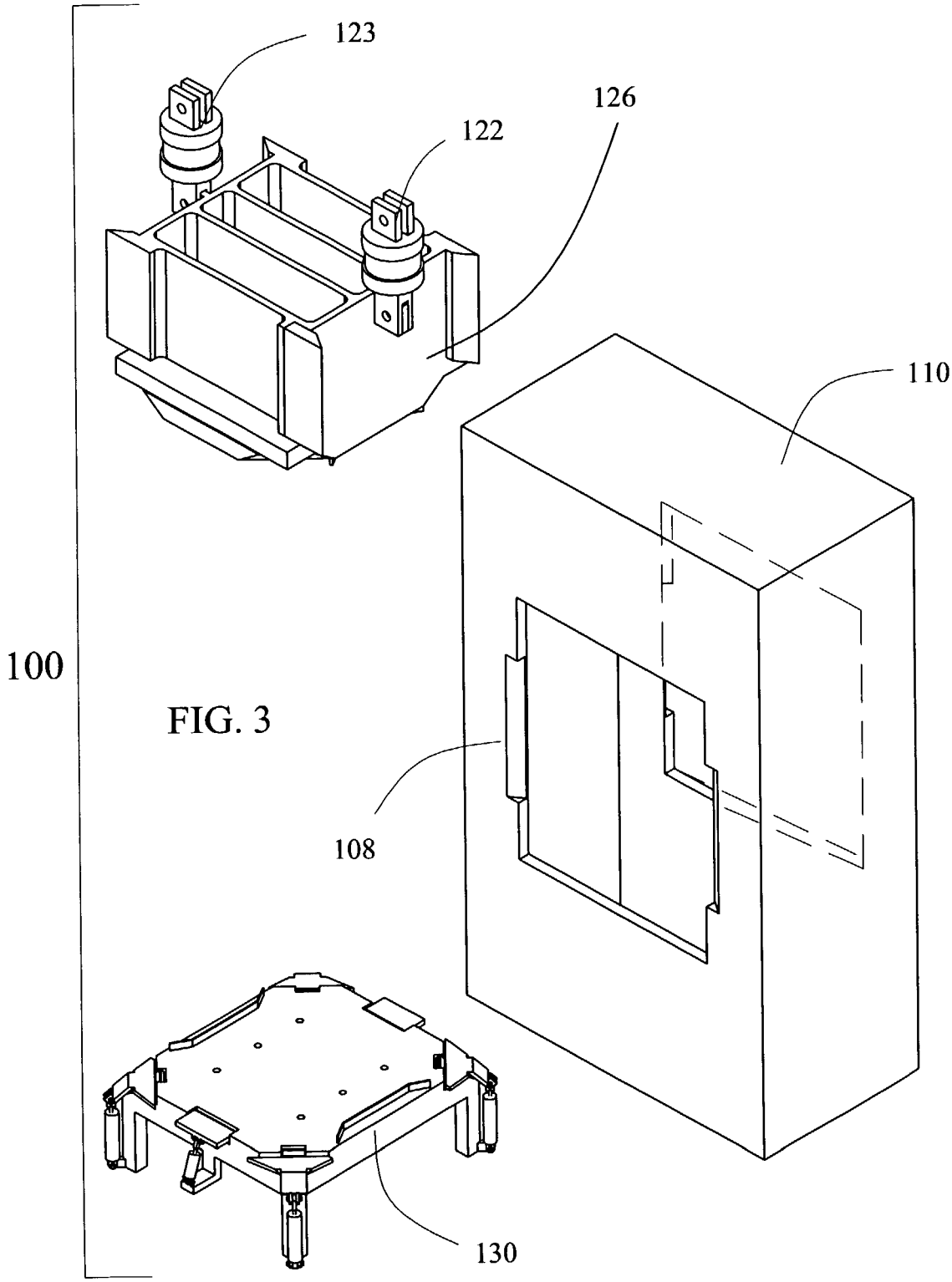
FIG. 3 illustrates an isolated view of a top plate assembly, a bottom plate assembly, and a cabinet.

Further appreciation of the metal unit nesting machine is gained by examining the machine systems in greater detail. Accordingly, FIG. 3 illustrates an isolated view of the cabinet 110, a first altering system 120 embodied as a top plate assembly, and a second altering system 130 embodied as a bottom plate assembly. To prevent cluttering the drawings, the cabinet 110 is illustrated without an internal skeleton structure or frame, which is typically used to support the top plate assembly 120 and the bottom plate assembly 130. Shown attached to the cabinet 110 in FIG. 3 are a plurality of guides 108 which properly vertically position a metal unit into the cabinet 110. The guides 108 are used when a metal unit is introduced into the cabinet 110 from an outside source, such as a conveyor belt or other automation source. It should be understood, however, that multiple metal plates may be introduced into the machine simultaneously by, for example, introducing two, or three or four plates that are stacked one-upon the other. According, the invention can bend/dimple, or otherwise adapt for stacking more than one metal unit at a time. The top plate assembly 120 is shown as a unified structure, with the first cylinder clamp 122 and the second cylinder clamp 123 coupled to the top plate support 126.

Figure 4A:
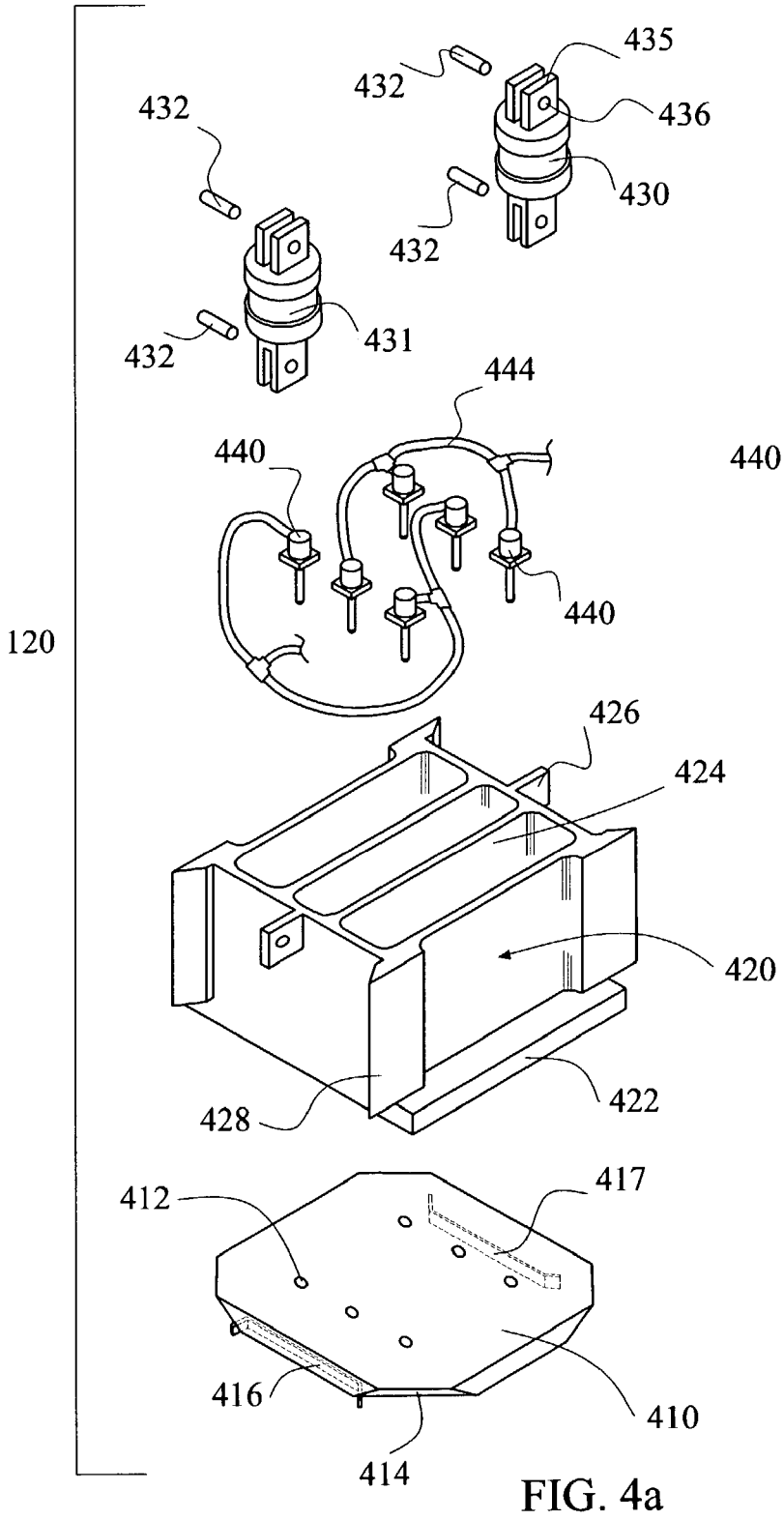
FIG. 4*a* provides an exploded view of a top plate assembly.

FIG. 4*a* provides an exploded view of the top plate assembly 120. The top plate assembly 120 of FIG. 4 includes a removable top plate 410 shaped to accommodate any bending produced by a bending system (shown below). As previously discussed, the removable top plate 410 includes a plurality of dimple guides 412, which are embodied herein as cavities in the removable top plate 410 extending vertically through the removable top plate 410 and are in alignment with a dimpled tool(s) as discussed below. As shown here, six dimple guides 412 are provided in the removable top plate 410 such that three dimples may be used to produce a triangle pattern in a metal unit. Of course, it should be understood that any number of dimple guides 412 may be provided in the removable top plate 410 to enable any variety of dimpled patterns to be produced in a metal unit. In addition, the geometric shape of the removable top plate 410 need not be octagonal, as shown in FIG. 4*a*, but may be any shape that accepts any bending system via inclined planes 414 (as needed to configure the metal units for stacking). Furthermore, the removable top plate 410 includes a metal unit guide system comprising a first top plate rail 416 and second top plate rail 417.

The top plate assembly 120 includes a top plate support 420 capable of enduring the bending forces placed on a metal unit. The top plate support 420 includes a mount plate 422 which may be integral with the top plate support 420, or rigidly attached to the top plate support 420. The mount plate 422 includes means for coupling the mount plate 422 to the removable top plate 410 (attachment means not shown). Similarly, the mount plate 422 has therein dimple guides 412 which align with at least the dimple guides 412 in the removable top plate 410. However, the mount plate 422 may comprise additional dimple guides 412 to accommodate additional configurations of removable top plates 410. The top plate support 420 generally comprises a plurality of vertically positioned ribs 424 which provide structural support for accommodating compression forces of bending and dimpling metal units.

In addition, the top plate support 420 includes a plurality of guide rails 428 which extend about the cabinet 110 and securely and rigidly affix the top plate support 420 (and thereby the top plate assembly 120) to the cabinet 110. Furthermore, a first clamp cylinder 430 and a second clamp cylinder 431 couple the top plate support 420 to the cabinet 110 via mounting brackets 426. Typically, pivot pins 432 are used to secure the clamp cylinders 430, 431 into both of the mounting brackets 426, and to the cabinet 110 through holes 436 in the clamps 435 of each clamp cylinder 430, 431.

Figure 4B:
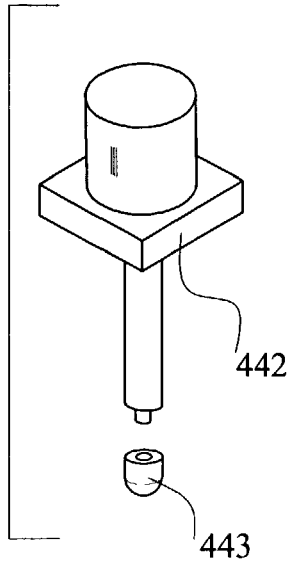
FIG. 4*b* is an exploded view of a dimple tool.

Articulation of a plurality of dimple tools 440 which create dimpling in metal units is achieved through the use of hydraulic input lines 444. The securing of punching-devices (here used as dimple tools 440) rigidly to a surface is well known in the art. FIG. 4*b* is an exploded view of a dimple tool, showing that the dimple tool comprises a dimple cylinder 442, which converts hydraulic pressure from a hydraulic input line 444 into a mechanical articulation of a dimple tool cylinder 445. The dimple tool cylinder 442 has affixed thereto a replaceable dimple tool tip 443, which is preferably a hardened tip capable of repeated impact with a metal unit.

Figure 5:
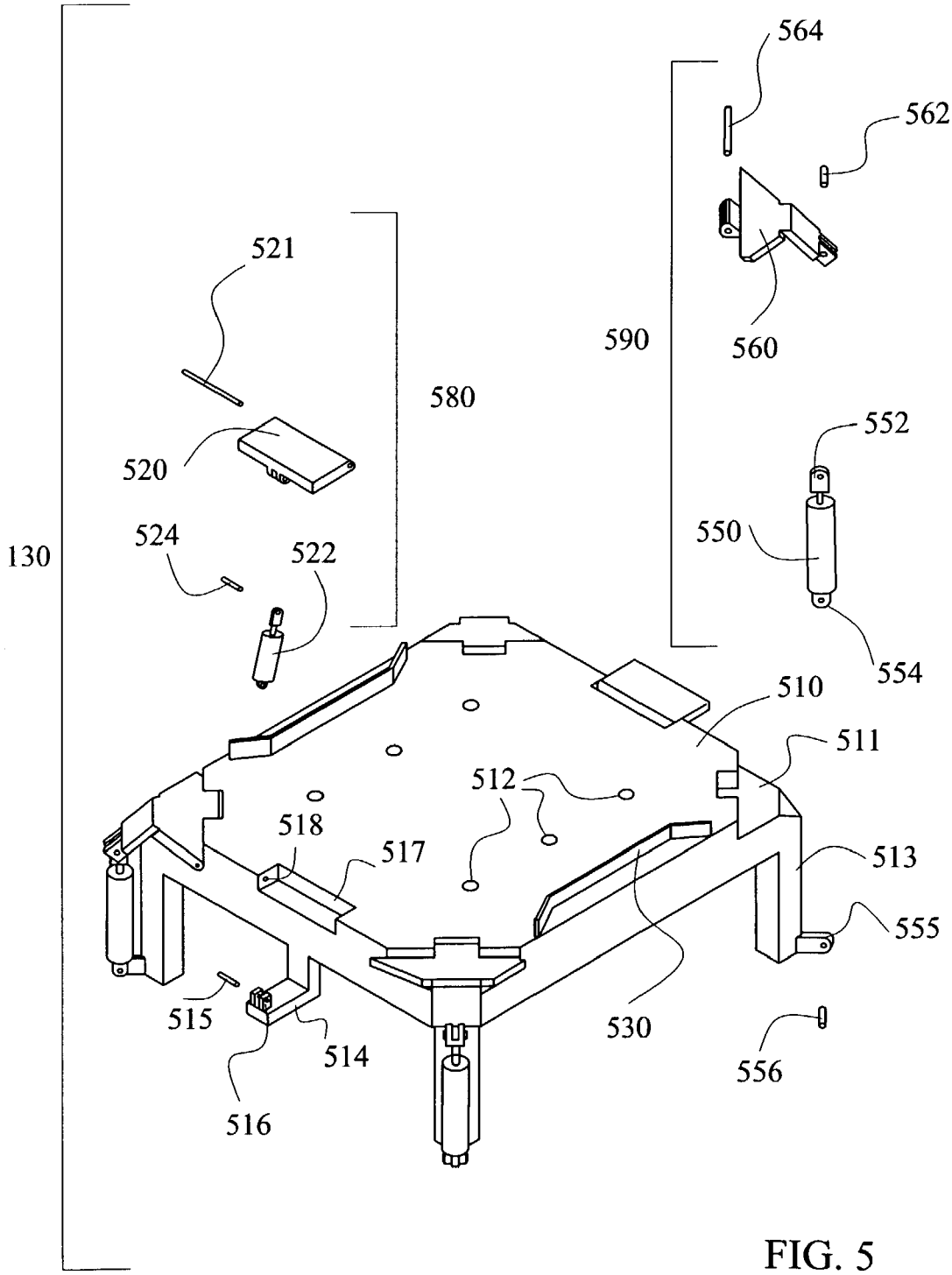
FIG. 5 is an exploded view of a bottom plate assembly.

FIG. 5 is an exploded view of a bottom plate assembly 130. The bottom plate assembly 130 includes a bottom plate 510, which has plurality of divot recesses 512 therein. The divot recesses 512 include a least a sufficient number of divot recesses in a proper alignment to accommodate divot producing dimple tools protruding from a corresponding top plate, such as the removable top plate 410. The bottom plate 520 includes a plurality of corner assemblies 590 as well as two centering assemblies 580 disposed opposite of each other. In addition, the bottom plate 510 provides a guide system comprising a first bottom plate rail guide 530 and a second bottom plate rail guide 531 so that a metal unit may maintain a proper vertical position when moving into the cabinet 110 and upon the bottom plate 510.

The bottom plate 510 provides a bending assembly recess, which corresponds to the portion of a metal unit that is to be bent. In FIG. 5, the bottom plate 510 provides four bending assembly recesses embodies as corner assembly recesses 511, one being located at each corner. Each corner also has a corner assembly 590.

Accordingly, each corner assembly 590 comprises a bending plate 560, which couples to the corner assembly recess 511 via a hinge pin 564. The bending plate is also coupled to the bottom plate 510 through a bending cylinder 550. The bending cylinder 550 attaches to the bending plate through a bending cylinder hook 552 having a hole therein for accepting a pivot pin 562. The bending cylinder 550 attaches to the bottom plate 590 via a looped bending cylinder clamp 555 that protrudes from a leg 513 of the bottom plate assembly 130. Although not shown, the articulation and control of the bending cylinder 550 is well known in the art, and thus a bending cylinder may be controllably actuated when a metal unit is properly situated and rigidly held in place upon the bottom plate assembly 130 such that a portion of the metal unit is bent.

The bottom plate 510 also maintains oppositely disposed centering assembly recesses 517 for accepting centering assemblies 580. A centering assembly 580 generally comprises a centering gate 520, which is rigidly attached to the bottom plate 590 via a centering gate hole 518 in the centering assembly recess 517 and hinge pin 521 combination. The centering gate 520 is actuated via a centering cylinder 522. The centering cylinder 522 is coupled to the centering gate 520 with a pivot pin 524, and is coupled to a pivot arm 514 of the bottom plate assembly 130 via a pivot pin 515, which in turn attaches to a root clamp 516.

Though the invention has been described with respect to a specific preferred embodiment, many variations and modifications will become apparent to those skilled in the art upon reading the present application—such as the application of the invention to the cutting of animal hair/fur. It is therefore the intention that the appended claims be interpreted as broadly as possible in view of the prior art to include all such variations and modifications.

I claim:

1. A machine system that alters metal plates to enable rigid stacking of the metal plates, the machine system comprising:

a machine cabinet;

a first altering system comprising a dimpling system is secured in the machine cabinet; and a second altering system secured in the machine cabinet, the second altering system being configured to interact with the first altering system to change the shape of an electrowon metal plate, and specifically adapted to bend a corner portion of a metal plate;

the machine cabinet is adapted to secure the second altering system, and also adapted to secure the first altering system above the second altering system such that a metal plate may be placed between the first altering system and the second altering system, the second altering system adapted to alter the metal plate such that a plurality of plates may be rigidly stacked one on top of the other.

2. A plate stacking machine, comprising:

a cabinet having a top portion and a bottom portion;

a dimpling system secured in the top portion; and a bending system secured in the bottom portion the dimpling system comprises:

a top plate having a dimple-guide therein;

a dimple tool configured to articulate in and out of the dimple guide, the tool movably secured to the plate stacking machine; and a hydraulic means that is adapted to articulate the dimple tool, the hydraulic means coupled to the dimple tool via a hydraulic line, and also coupled to the plate stacking machine.

3. The plate stacking machine of claim 2 wherein the top plate further comprises a metal plate guide adapted to guide a metal plate into alignment with the top plate, the metal plate guide being secured to the top plate.

4. The plate stacking machine of claim 2 further comprising a top plate support coupled to the top plate and to the plate stacking machine.

5. The plate stacking machine of claim 4 wherein the top plate is coupled to the top portion via a clamp cylinder, and the clamp cylinder adapted to pinch the metal plate between the top portion and the bottom portion.

6. The plate stacking machine of claim 2 wherein the dimple tool comprises: a dimple cylinder coupled to the hydraulic line, and a replaceable dimple tool tip that is remotely affixed to the dimple cylinder.

7. A plate stacking machine, comprising:

a cabinet having a top portion and a bottom portion;

a dimpling system secured in the top portion; and a bending system secured in the bottom portion, the dimpling system and the bending system accommodate electrowon metal plates the bending system comprises a bottom plate having a bending plate assembly, the bending plate for bending a corner of a metal plate; and a first guide rail and a second guide rail secured to the bottom plate, and adapted to guide a metal plate into alignment with the bottom plate.

8. A plate stacking machine, comprising:

a cabinet having a top portion and a bottom portion;

a dimpling system secured in the top portion; and a bending system secured in the bottom portion, the dimpling system and the bending system accommodate electrowon metal plates the bending system comprises a bottom plate having a bending plate assembly, the bending plate for bending a corner of a metal plate; and a centering gate assembly coupled to the bottom plate.

9. A plate stacking machine, comprising:

a cabinet having a top portion and a bottom portion;

a dimpling system secured in the top portion; and a bending system secured in the bottom portion, the dimpling system and the bending system accommodate electrowon metal plates the bending system comprises a bottom plate having a bending plate assembly, the bending plate for bending a corner of a metal plate; and a bending cylinder coupled between a bending plate and the plate stacking machine, the bending cylinder for articulating the bending plate so that a corner of a metal plate can be bent.

10. A method of enabling the stacking of metal plates, comprising:

securing a metal plate in a plate stacking machine;

dimpling a metal plate by articulating a dimpling system; and articulating a corner bending system in the plate stacking machine to bend at least two corners of the metal plate.

* * * * *